US008782908B2

(12) United States Patent
Moffatt et al.

(10) Patent No.: US 8,782,908 B2
(45) Date of Patent: Jul. 22, 2014

(54) STUD PUNCH TOOL

(75) Inventors: Wilbur Keith Moffatt, Freeport, IL (US); John T. Hagan, Roscoe, IL (US)

(73) Assignee: Textron Innovations Inc., Providence, RI (US)

( * ) Notice: Subject to any disclaimer, the term of this patent is extended or adjusted under 35 U.S.C. 154(b) by 1016 days.

(21) Appl. No.: 12/643,461

(22) Filed: Dec. 21, 2009

(65) Prior Publication Data

US 2011/0146085 A1 Jun. 23, 2011

(51) Int. Cl.
*B26F 1/00* (2006.01)

(52) U.S. Cl.
USPC ..... 30/251; 30/363

(58) Field of Classification Search
USPC ..... 30/363, 251, 250, 211; 83/686, 518
See application file for complete search history.

(56) References Cited

U.S. PATENT DOCUMENTS

| | | | | | |
|---|---|---|---|---|---|
| 1,563,671 | A * | 12/1925 | Spengler | 30/363 |
| 1,576,681 | A * | 3/1926 | Spengler | 30/363 |
| 1,674,844 | A * | 6/1928 | Spengler | 30/363 |
| 3,842,650 | A * | 10/1974 | Hartmeister | 72/409.01 |
| 4,380,871 | A | 4/1983 | Adleman | |
| 4,729,170 | A * | 3/1988 | Hartmeister | 30/363 |
| 5,560,110 | A * | 10/1996 | Haines | 30/363 |
| 6,189,220 | B1 * | 2/2001 | Chen | 30/358 |
| 6,367,362 | B1 | 4/2002 | Brazell et al. | |
| 6,647,630 | B1 | 11/2003 | Lucas et al. | |
| 6,711,930 | B2 * | 3/2004 | Thom et al. | 72/409.01 |
| 6,751,874 | B2 * | 6/2004 | Eldar | 30/363 |
| 6,752,054 | B2 * | 6/2004 | Knight | 83/13 |
| 2002/0124420 | A1 * | 9/2002 | Hsuan | 30/363 |
| 2003/0204957 | A1 * | 11/2003 | Eldar | 30/366 |
| 2005/0050740 | A1 * | 3/2005 | Lin | 30/363 |
| 2005/0274027 | A1 * | 12/2005 | Eldar | 30/363 |
| 2009/0064509 | A1 * | 3/2009 | Farnworth et al. | 30/363 |

FOREIGN PATENT DOCUMENTS

| | | |
|---|---|---|
| GB | 6035 | 0/1905 |

* cited by examiner

*Primary Examiner* — Omar Flores Sanchez
(74) *Attorney, Agent, or Firm* — Klintworth & Rozenblat IP LLC

(57) ABSTRACT

A stud punch tool includes a lower frame, an upper handle pivotally attached to the lower frame, and a punching assembly attached to the lower frame and to the upper handle. The lower frame includes a body portion, a pair of ears extending upwardly therefrom, and a head portion and a handle portion extending from the body portion. The upper handle is attached to the ears. The punching assembly is connected to the head portion and is connected to the upper handle proximate to the connection of the upper handle to the ears. The upper handle can be gripped by a user for movement relative to the lower frame to cause the punching assembly to punch a hole in an associated workpiece.

35 Claims, 13 Drawing Sheets

STUD PUNCH TOOL

FIELD OF THE INVENTION

This invention is generally directed to a stud punch tool for punching a hole in a workpiece.

BACKGROUND OF THE INVENTION

For many years, those working in the plumbing industry have required tools that would allow them to punch holes in steel studs and/or sheet metal to allow them to run plumbing pipe therethrough. The tools that have evolved for this purpose have had some drawbacks. One such drawback is that the hand operated punches have required a large amount of handle force to punch a large hole, i.e., one with a diameter of over two and a half inches. If the required handle force were reduced, the punch was usually not provided with enough travel to allow the punch to clear the stud.

The stud punch tool disclosed in U.S. Pat. No. 6,647,630 overcame these drawbacks and quickly became accepted by the workforce. The stud punch tool disclosed in U.S. Pat. No. 6,647,630, however, has a relatively complex link system to connect the upper handle to the lower frame. In addition, the upper handle is connected at the front, free end of the lower frame, which during punching, can cause the head portion to deflect as a result of the load transferred to the lower frame from the upper handle during a punching operation. Deflection of the head portion can cause the punch and die to mis-align, which can cause higher punch forces or stalling of the punching process due to binding. In addition, deflection of the head portion can cause damage to the punch and/or die. Morever, the provision of the link is costly from a manufacturing standpoint, as the link increases the number of parts required to form the stud punch tool.

SUMMARY OF THE INVENTION

A stud punch tool includes a lower frame, an upper handle pivotally attached to the lower frame, and a punching assembly attached to the lower frame and to the upper handle. The lower frame includes a body portion, a pair of ears extending upwardly from the body portion and terminating in free ends, a head portion extending from the body portion, and a handle portion extending from the body portion. The upper handle is attached to the free ends of the ears. The punching assembly is connected to the head portion of the lower frame and is connected to the upper handle proximate to the connection of the upper handle to the ears. The upper handle can be gripped by a user for movement relative to the lower frame to cause the punching assembly to punch a hole in an associated workpiece.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENT

Figure 1:
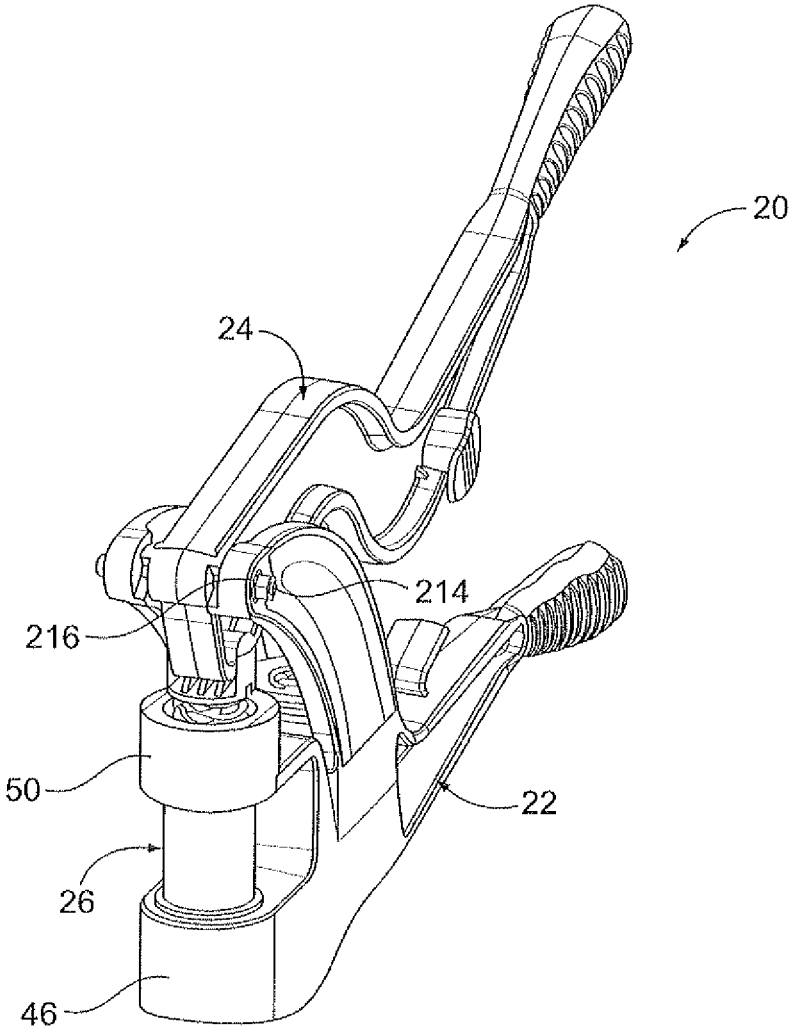
FIG. 1 is a front perspective view of a stud punch tool.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein.

A stud punch tool 20 generally includes a lower frame 22, an upper handle 24 which is pivotally connected to the lower frame 22, and a punching assembly 26. The upper handle 24 can be moved by a user relative to the lower frame 22 to activate the punching assembly 26. While terms such as front, rear, forward, rearward, upper, top, lower, bottom and the like are used in the following for ease of description and for reference purposes; the stud punch tool 20 does not necessarily have to be used in the manner shown in the illustrations; for example, the stud punch tool 20 could be used by a user with the lower frame 22 and the upper handle 24 being perpendicular to or angled relative to the ground.

FIGS. 3-6 illustrate the lower frame 22. The lower frame 22 is generally formed of a body portion 28, an elongated handle portion 30, a head portion 32 which receives the punching assembly 26, and first and second ears 34, 36 which connect to the upper handle 24.

The body portion 28 is elongated and has a front end 38, a rear end 40, an upper surface 42 and a lower surface 44. The handle portion 30 is connected to the rear end 38 of the body portion 28. It should be noted that the handle portion 32 can be formed as a separate component than the body portion 28 and attached thereto, or can be integrally formed with the body portion 28. The handle portion 32 preferably has a material thereon that facilitates the gripping of the handle portion 32 by a user's hand. The centerline of the body portion 28 defines a neutral plane 54 of the lower frame 22.

The head portion 32 is provided at the front end 38 of the body portion 28. The head portion 32 is formed of a C-frame which includes a lower portion 46, a middle portion 48 and an upper portion 50, such that an opening 52 is provided between the lower and upper portions 46, 50. The head portion 32 is integrally formed with the body portion 28 at the second end thereof.

Figure 4:
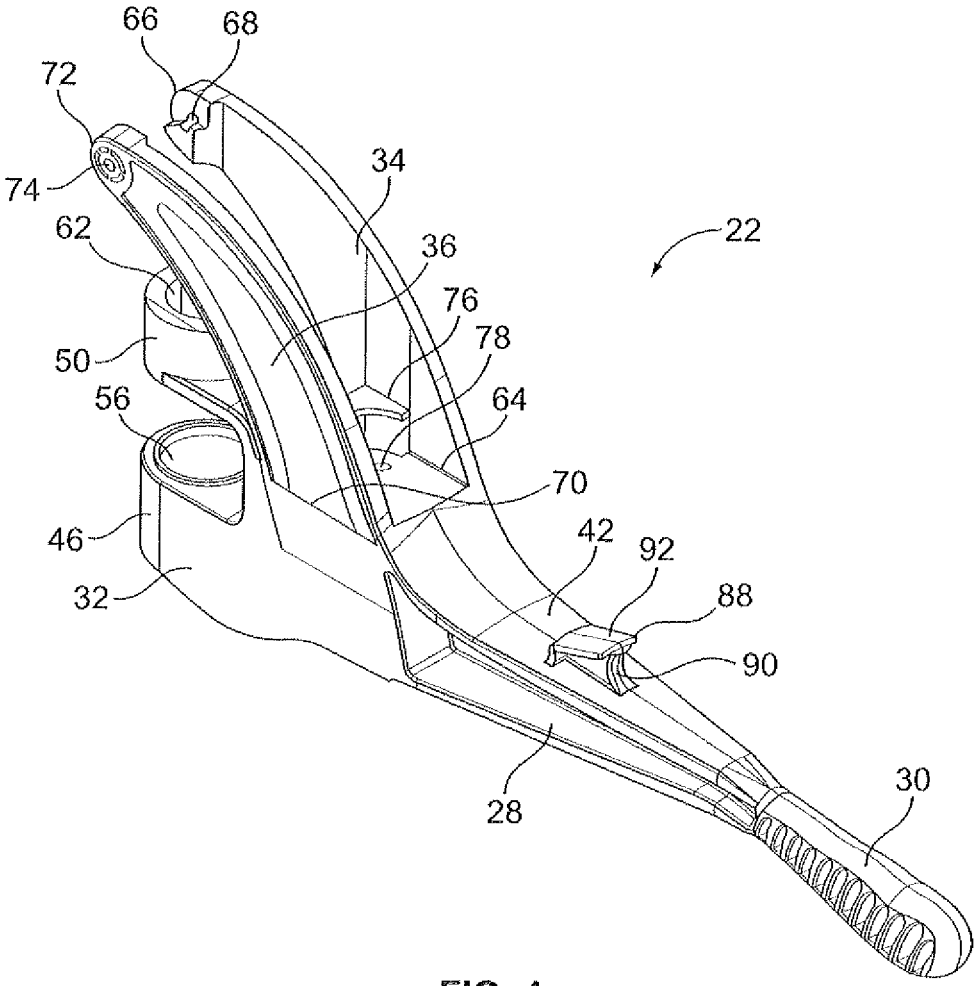
FIG. 4 is a rear perspective view of the lower frame.
Figure 5:
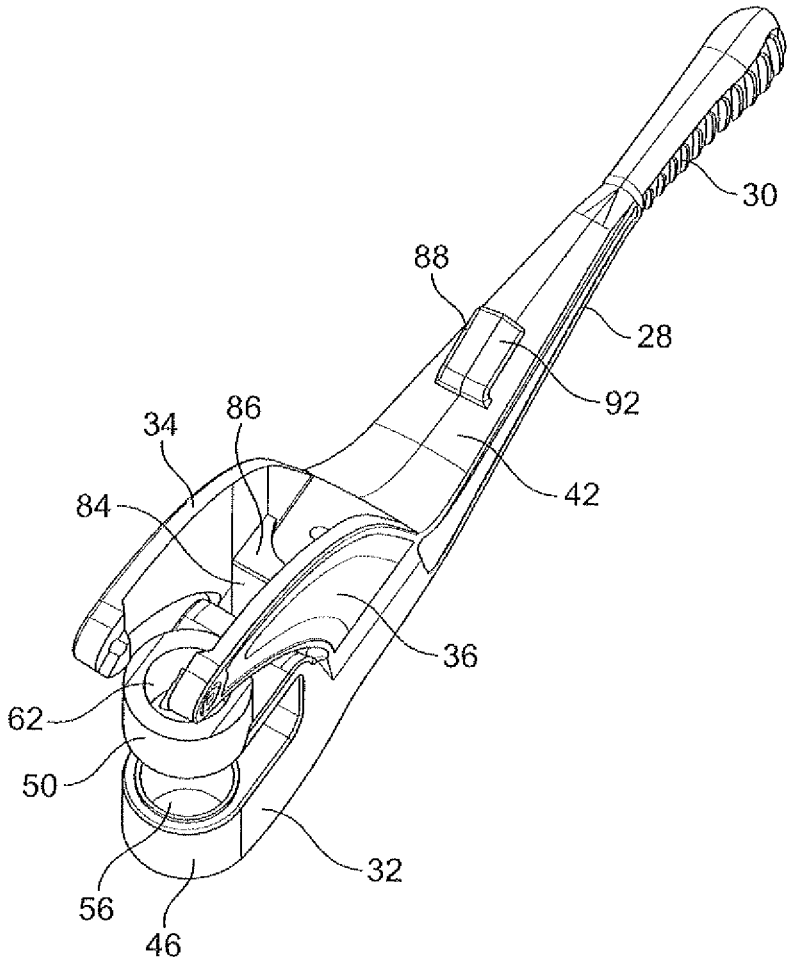
FIG. 5 is a top perspective view of the lower frame.
Figure 6:
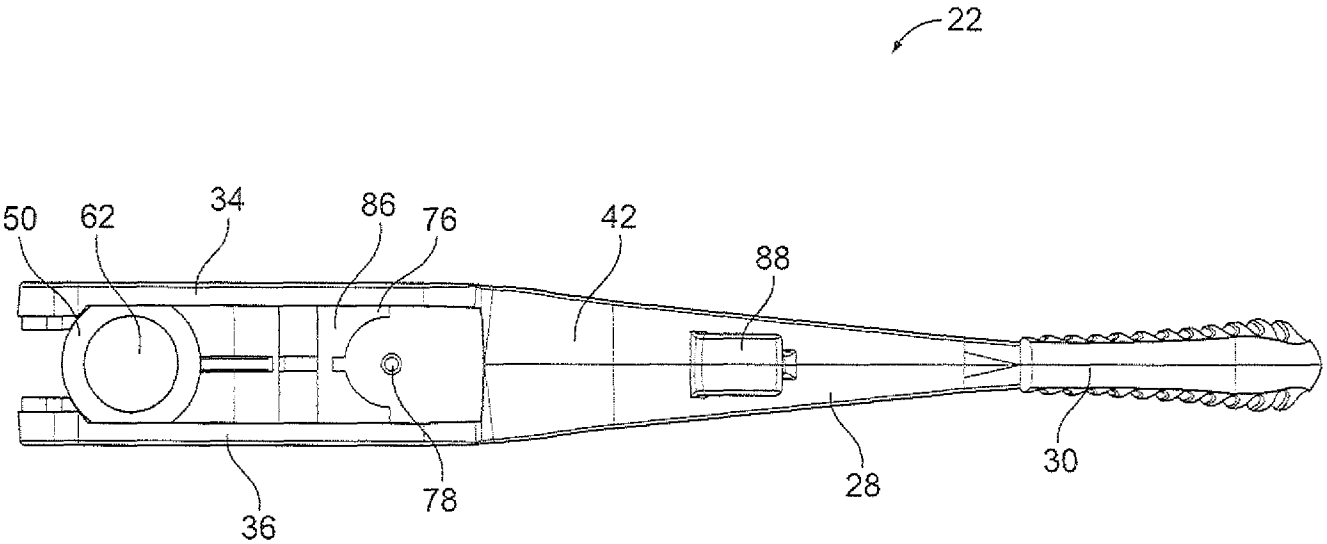
FIG. 6 is a top plan view of the lower frame.

The lower portion 46 has a top, a bottom, and a continuous side therebetween. The lower portion 46 extends outwardly from the front end of the body portion 28 in a direction parallel to the centerline of the body portion 28. The top of the lower portion 46 is positioned below the opening 52. As best illustrated in FIGS. 4 and 5, the lower portion 46 has a generally circular cross-section. A generally circular bore 56 extends through the lower portion 46 from the top to the bottom such that the bore 56 is in communication with the opening 52. The bore 56 is dimensioned such that a portion of the punching assembly 26, which will be described in more detail herein, can move into the bore 56.

The middle portion 48 extends from the front end 38 of the body portion 28 and has a vertical section 58 which extends upwardly from the front end 38 in a direction transverse to the centerline of the body portion 28, and a horizontal section 40 which extends forwardly from the upper end of the vertical section 58 in a direction parallel to the centerline of the body portion 28. The middle portion 48 is integrally formed with the top of the lower portion 46.

The upper portion 50 has a top, a bottom, and a continuous side therebetween, and extends from the front end of the horizontal section 40. The bottom is proximate to the opening 52 and is aligned with the horizontal section 40 of the middle portion 48. The side extends upwardly from the horizontal section 58. As best illustrated in FIGS. 4 and 5, the upper portion 50 has a generally circular cross-section, and a generally circular bore 62 extends through the upper portion 50 from the top 48 to the bottom 50 such that the bore 62 is in communication with the opening 52. The bore 62 is dimensioned such that the punching assembly 26, which will be described in more detail herein, can move therethrough.

Bores 56 and 62 are vertically aligned with each other.

The first and second ears 34, 36 extend from the upper surface 42 of the body portion 28 and are spaced apart from each other such that the first ear 34 is on one side of the body portion 28 and the second ear 36 is on the other side of the body portion 28. The first ear 34 has a fixed end 64 which is connected to the body portion 28 rearwardly of the head portion 32, and a free end 66. The first ear 34 extends upwardly from the fixed end 64 and terminates in the free end 66 which terminates forwardly of the front end of the head portion 32. An aperture 68 is provided through the free end 66 transverse to the centerline of the body portion 28. The second ear 36 has a fixed end 70 which is connected to the body portion 28 rearwardly of the head portion 32, and a free end 72. The second first ear 36 extends upwardly from the fixed end 70 and terminates in the free end 72 which terminates forwardly of the front end of the head portion 32. An aperture 74 is provided through the free end 72 transverse to the centerline of the body portion 28. The apertures 68, 72 are horizontally aligned. The aligned bores 56, 62 through the lower and upper portions 44, 46 are not obstructed by the ears 34, 36.

A spare retaining frame 76 is provided on the upper surface 42 of the body portion 28 for holding a spare die 154' and a spare punch 160' as discussed herein. The spare retaining frame 76 is provided between the fixed ends 64, 70 of the ears 34, 36. The spare retaining frame 76 has a vertical wall 84 which extends upwardly from the upper surface 42 of the body portion 28 and a horizontal wall 86 which extends from the upper end of the vertical wall 84 and rearwardly toward the rear end 40 of the body portion 28.

A clip retainer 88 extends from the upper surface 42 of the body portion 28 rearwardly of the first and second ears 34, 36. The clip retainer 88 is formed of a lower wall 90 and an upper wall 92. The lower wall 90 extends vertically upwardly from the upper surface 46 and is parallel to the centerline of the body portion 28. The top surface of the lower wall 90 angles upwardly from its forward end to its rearward end. The upper wall 92 sits on the upper surface of the lower wall 90 such that the upper wall 92 is angled relative to the centerline of the body portion 28. The upper wall 92 has a width which is greater than the lower wall 90.

Figure 7:
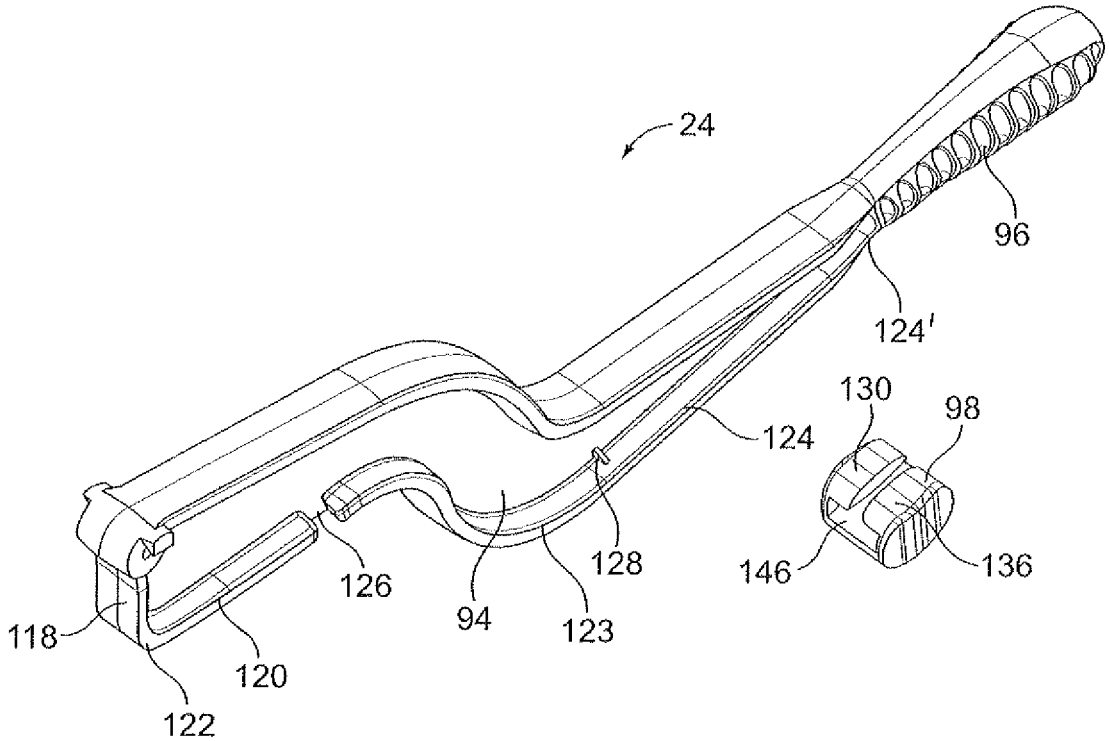
FIG. 7 is a front perspective view of an upper handle of the stud punch tool.
Figure 8:
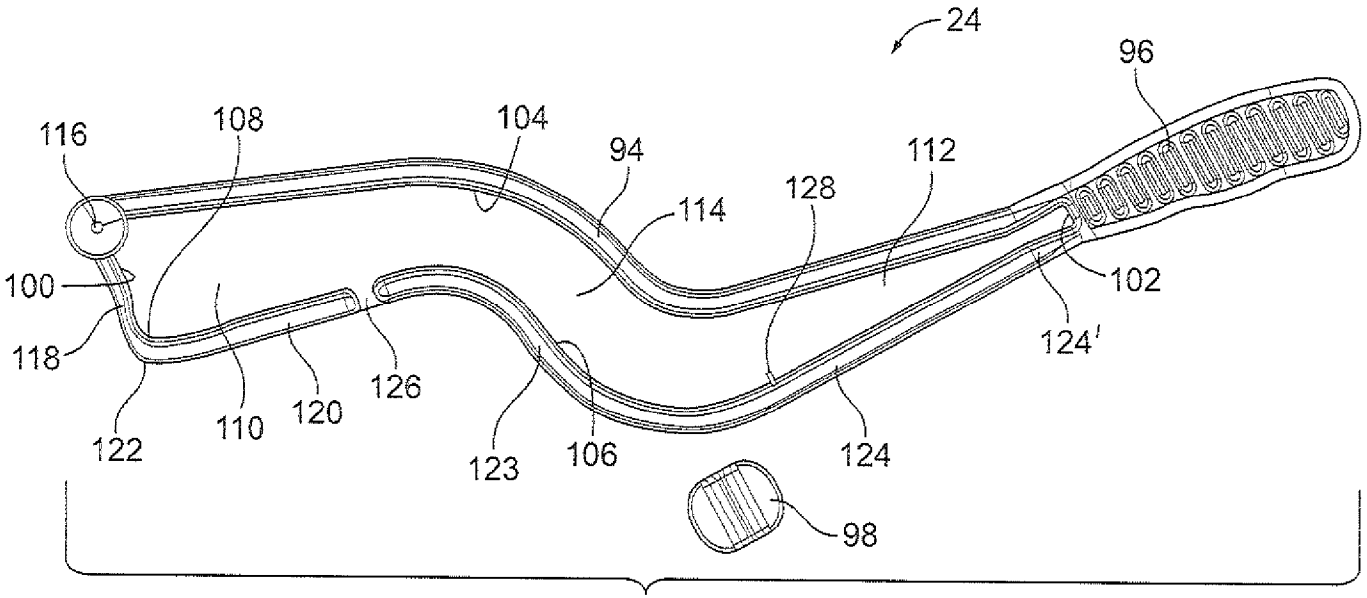
FIG. 8 is a side elevational view of the upper handle.

FIGS. 7 and 8 illustrate the upper handle 24 of the stud punch tool 20. The upper handle 24 has an elongated body portion 94, an elongated handle portion 96 extending therefrom, and a clip 98 which is mounted on the body portion 94.

The body portion 94 has a front end 100, a rear end 102, a top end 104 and a bottom end 106. The body portion 94 has a width which is defined between side surfaces thereof. The front end 100 and the bottom end 102 of the body portion join at a rounded corner 108. The body portion 94 includes a forward section 110 extending from the front end 100, a rearward section 112 extending from the rear end 102, and a middle section 114 between said forward and rearward sections 110, 112. The centerlines of the forward and rearward sections 110, 112 are generally parallel to and offset from each other. The middle section 114 is curved to connect the forward and rearward sections 110, 112 together. The bottom end 106 of the rearward section 112 tapers from the middle section 114 to the handle portion 96 such that the rearward section 112 has a smaller height proximate to the handle portion 96 than proximate to the middle section 114. A aperture 116 is provided through the body portion 94 proximate to the corner formed between the front end 100 and the top end 104. The aperture 116 is transverse to the centerline of the upper handle 24.

The rear end 102 of the body portion 94 is connected to the handle portion 96. It should be noted that the handle portion 96 can be formed as a separate component than the body portion 94 and attached thereto or can be integrally formed with the body portion 94. The handle portion 96 preferably has a material thereon that facilitates the gripping of the handle portion 96 by a user's hand.

A front lip 118 is provided at the front end 100 of the forward section 110 and is perpendicular to the body portion 94. The front lip 118 has a width which is greater than the body portion 94 such that sections of the front lip 118 extend outwardly from respective sides of the body portion 94. A forward section lip 120 is provided at the bottom end 106 of the forward section 110 and is perpendicular to the body portion 94. The forward section lip 120 has a width which is greater than the body portion 94 such that sections of the forward section lip 120 extend outwardly from respective sides of the body portion 94. The width of the forward section lip 120 and the width of the front lip 118 is the same. The corner formed between the front lip 118 and the forward section lip 120 is rounded to mimic the rounded corner 108 and to form a cam surface 122 for reasons described herein.

A middle section lip 123 is provided at the bottom end 106 of the middle section 114 and is perpendicular to the body portion 94. The middle section lip 123 has a width which is greater than the body portion 94 such that sections of the middle section lip 123 extend outwardly from respective sides of the body portion 94. A gap 126 is provided between the middle section lip 123 and the forward section lip 120 for reasons described herein.

A rearward section lip 124 is provided at the bottom end 106 of the rearward section 112 and is perpendicular to the body portion 94. The rearward section lip 124 merges with the middle section lip 123. The rearward section lip 112 has a width which is greater than the body portion 94 such that sections of the rearward section lip 124 extend outwardly from respective sides of the body portion 94. A rear portion 124' of the rearward section lip 124 has a reduced thickness relative to the remainder of the rearward section lip 124. A stop 128, which takes the form of a protuberance, extends upwardly from the rearward section lip 124 on each side of the body portion 94, however, the stop 128 may be provided on only one side of the body portion 94, if desired.

Figure 9:
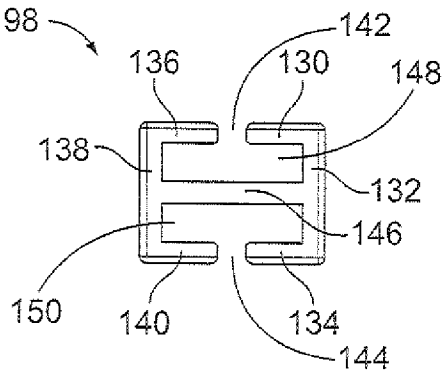
FIG. 9 is a front elevational view of a clip which is mounted on the upper handle.
Figure 10:
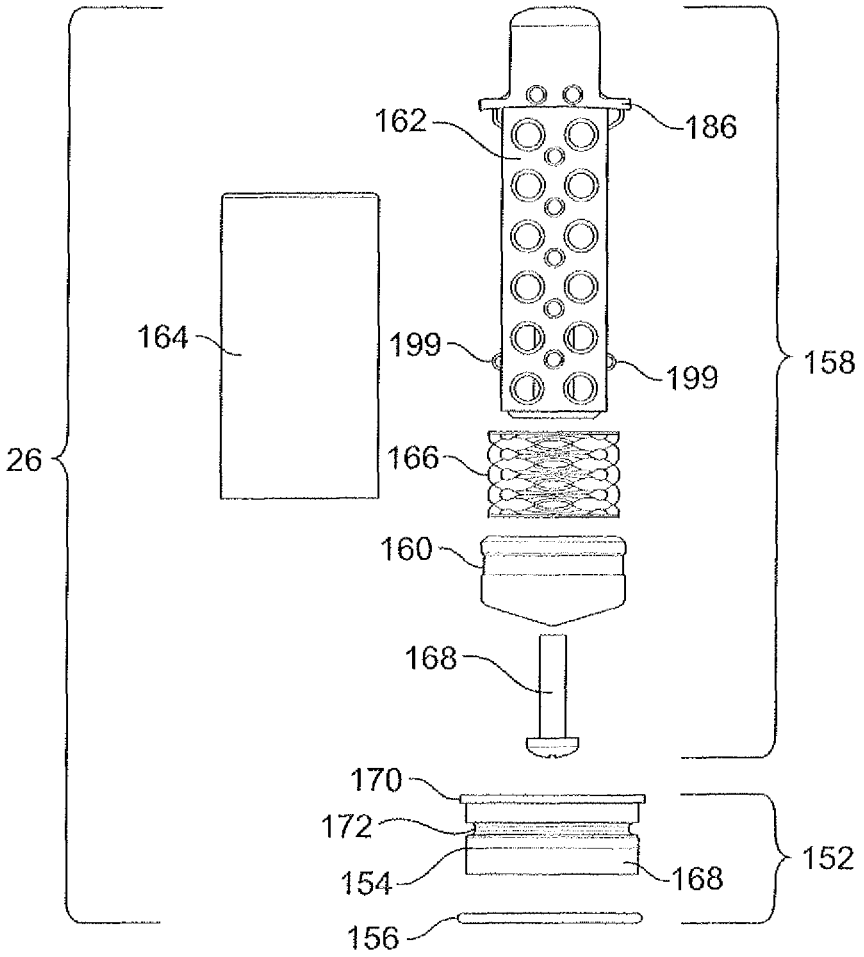
FIG. 10 is an exploded side elevational view of a punching assembly of the stud punch tool.
Figure 11:
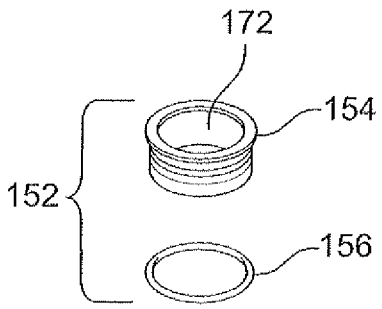
FIG. 11 is an exploded perspective view of a lower assembly of the punching assembly.
Figure 12:
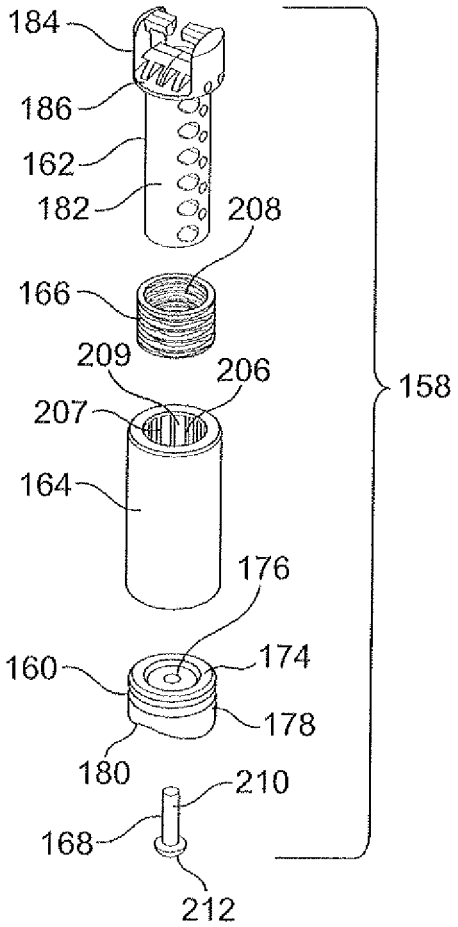
FIG. 12 is an exploded perspective view of an upper assembly of the punching assembly.

The clip 98 is slidably mounted on the rearward section lip 124 rearwardly of the stops 128. As shown in FIGS. 7 and 9, the clip 98 has a pair of generally C-shaped sections joined together by a bridge wall. The first C-shaped section has an upper horizontal wall 130 having an inner end and an outer end, a vertical wall 132 having an upper end connected to the outer end of the upper horizontal wall 130 and a lower end, and a lower horizontal wall 134 having an outer end connected to the lower end of the vertical wall 132 and an inner end. The second C-shaped section has an upper horizontal wall 136 having an inner end and an outer end, a vertical wall 138 having an upper end connected to the outer end of the upper horizontal wall 136 and a lower end, and a lower horizontal wall 140 having an outer end connected to the lower end of the vertical wall 138 and an inner end. The vertical walls 132, 138 are spaced apart from each other a distance which is approximately the same width as the rearward section lip 124 and the same width as the upper wall 92 of the clip retainer 88. The upper horizontal walls 130, 136 are aligned with each other and the inner ends thereof are spaced apart from each other by an upper slot 142. The width of the upper slot 142 is slightly larger than the width of the body portion 94 and less than the width of the rearward section lip 124. The lower horizontal walls 134, 140 are aligned with each other and the inner ends thereof are spaced apart from each other by a lower slot 144. The width of the lower slot 144 is slightly larger than the width of the lower wall 90 of the clip retainer 88. The bridge wall 146 is parallel to the horizontal walls 130, 134, 136, 140 and extends between the vertical walls 132, 138 at approximately the midpoint thereof. As a result, an upper passageway 148 is provided through the clip 98 by the inner surfaces of the upper horizontal walls 130, 136, the upper half of the vertical walls 132, 138 and the upper surface of the bridge wall 146, and a lower passageway 150 is provided through the clip 98 by the inner surfaces of the lower horizontal walls 134, 140, the lower half of the vertical walls 132, 138 and the lower surface of the bridge wall 146. The upper passageway 148 is in fluid communication with the upper slot 142, and the lower passageway 150 is in fluid communication with the lower slot 144.

The clip 98 is attached to the rearward section lip 124 by snapping the upper horizontal walls 130, 136 over the rear portion 124' of the rearward section lip 124. The rearward section lip 124 then slides within the upper passageway 148. The clip 98 can move forward until the clip 98 abuts against the stops 128. Thereafter, the clip 98 can be slid along the rearward section 112 between the handle portion 96 and the stops 128.

FIGS. 10-14 illustrate the specifics of the punching assembly 26. The punching assembly 26 is positioned within the lower and upper portions 46, 50 of the head portion 32 and is attached to the upper handle 24. The punching assembly 26 includes a lower assembly 152 which includes a die 154 and an O-ring 156, and an upper assembly 158 which includes a punch 160, a punch actuator 162, a punch sleeve 164, a spring 166 and a fastener 168.

The die 154 is positioned within the bore 56 of the lower portion 46 of the lower frame 22. The die 154 has a lower cylindrical wall 168 which has a flange 170 extending outwardly from a top end thereof. The lower wall 168 has a recess 172 which extends around the circumference thereof and into which the O-ring 156 is mounted. The lower wall 168 of the die 154 is sized to fit within the bore 56 of the lower portion 46 and the O-ring 156 engages the inner wall of the bore 56 to maintain the die 154 in the lower portion 46 by a friction fit. The flange 170 sits on top of the top surface of the lower portion 46. The die 154 has a circular bore 172 therethrough such that the punching assembly 26 can move through the die 154 during the punching process.

A conventional punch 160 is provided. The punch 160 includes a base wall 174 having an aperture 176 therethrough and a circular side wall 178 extending from the base wall 174. A cutting/punching edge 180 is provided on the free end of the side wall 178. A recess is provided by the inner surface of the side wall 178 and the lower surface of the base wall 176. The side wall 178 has a diameter that is slightly less than that of the circular bore 172 in the die 154 mounted in the lower portion 46.

Figure 13:
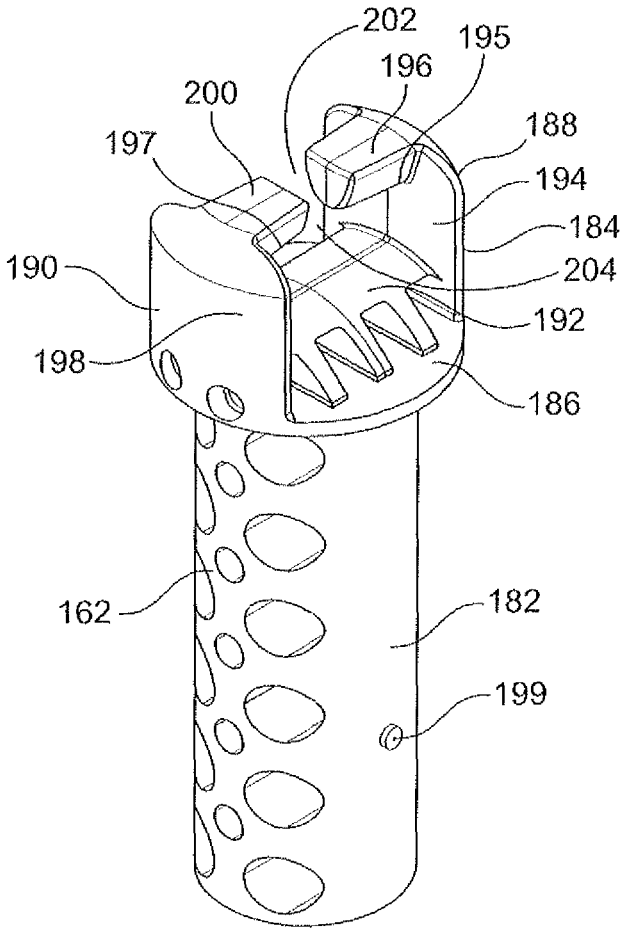
FIG. 13 is a perspective view of a punch actuator which forms part of the upper assembly.

The punch actuator 162 has a shaft 182 formed as a cylinder which has been cored and a can engagement 184 provided at an upper end of the shaft 182. As best shown in FIG. 13, the cam engagement 184 includes a circular base wall 186 which is perpendicular to the centerline of the shaft 182 and which extends outwardly from the shaft 182, a first L-shaped arm provided on one edge of the base wall 186, a second L-shaped arm 190 provided on the diametrically opposed edge of the base wall 186, and a cam surface 192 on the base wall 186. The first L-shaped arm 184 includes a vertical section 184 which extends upwardly from the base wall 186 and is perpendicular thereto, and a horizontal section 196 which is perpendicular to the vertical section 188 and which extends radially inwardly. The bottom end of the horizontal section 196 has a cam surface 195 provided thereon. The second L-shaped arm 190 includes a vertical section 198 which extends upwardly from the base wall 186 and is perpendicular thereto, and a horizontal section 200 which is perpendicular to the vertical section 198 and which extends radially inwardly. The bottom end of the horizontal section 200 has a cam surface 197 provided thereon. The distance between the inner surfaces of the vertical sections 194, 198 is greater than the width of the cam surface 122 on the upper handle 24. A slot 202 is provided between the horizontal sections 196, 200 which has a width which is slightly greater than the body portion 94 and less than the width of the forward section lip 120. The cam surface 192 is a rounded surface which has its apex directly below the slot 202. The cam surfaces 195, 197 are rounded surfaces which have their apexes aligned with the apex of the cam surface 192. A passageway 204 is provided between the apex of the earn surface 192 and the cam surfaces 195, 197.

A pair of protrusions 199 extend outwardly from the shaft 182 from diametrically opposed positions. The protrusions 199 are at a location which is spaced from the lower end of the shaft 182. The shaft 182, including the portion with the protrusions 199, has a diameter which is less than the diameter of the bore 62 through the upper portion 50 of the lower frame 22, and the base wall 186 has a diameter which is greater than the diameter of the bore 62.

Figure 14:
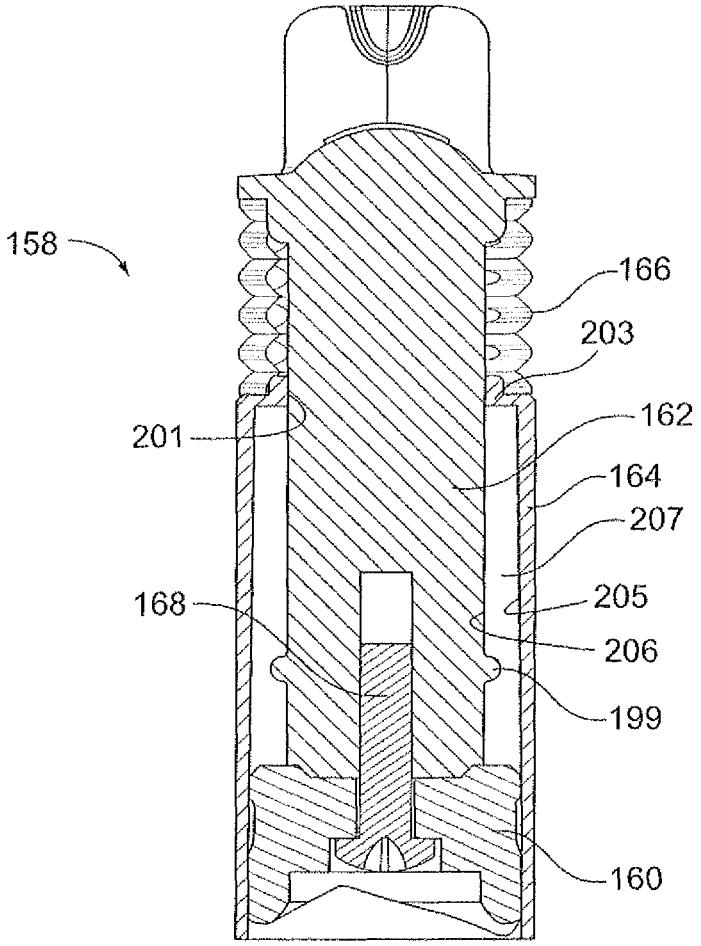
FIG. 14 is a cross-sectional view of the upper assembly with a punch sleeve shown partially in cross-section and partially cut-away.
Figure 15:
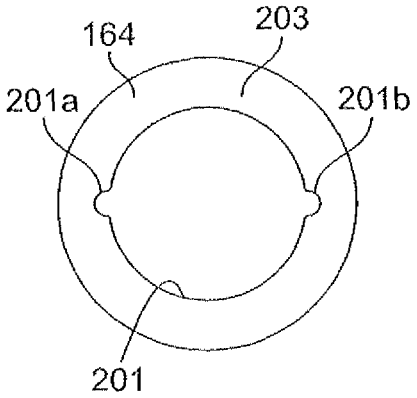
FIG. 15 is a top plan view of the punch sleeve.
Figure 16:
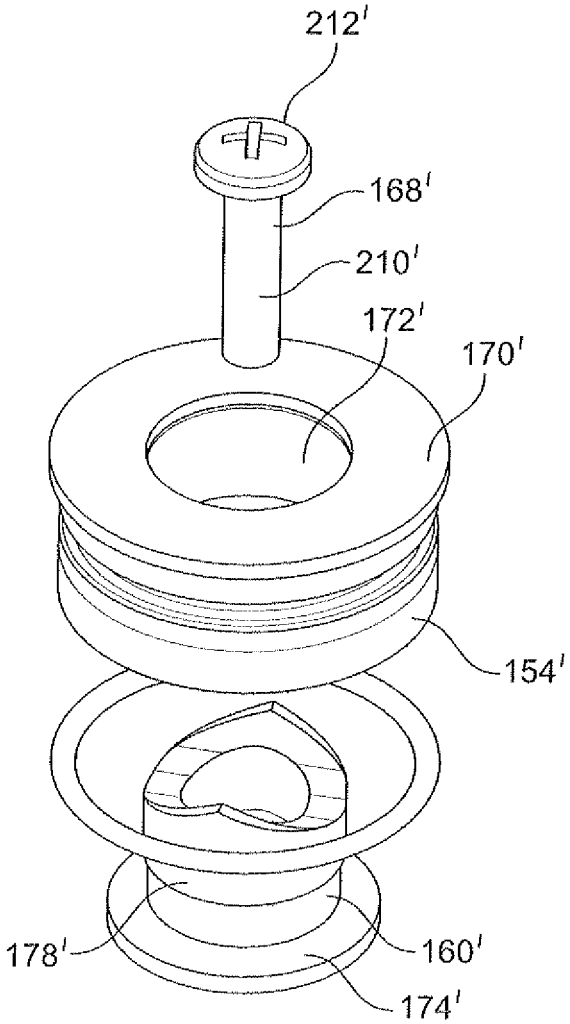
FIG. 16 is an exploded perspective view of a spare die and punch which is attached to the stud punch tool.

As best shown in FIG. 14, the punch sleeve 164 is a hollow cylinder. The punch sleeve 164 has a central passageway 206 defined by an aperture 201 through a top wall 203 and the inner surface of side wall 205 having a plurality of spaced apart ribs 207 extending radially inwardly therefrom. As a result, elongated recesses 209 are formed between adjacent ribs 207. The top wall 203 has a pair of recesses 201*a*, 201*b* which extend radially outwardly from aperture 201. Two of the elongated recesses 209 align with the respective recesses 201*a*, 201*b*, with the remaining elongated recesses 209 being offset from the recesses 201*a*, 201*b*. The ribs 207 extend from the top wall 203 to a position which is spaced from a lower end of the punch sleeve 164. As a result, the central passageway 206 has an upper portion which extends from the aperture 201 to the bottom end of the ribs 207, and a lower portion which extends from the bottom end of the ribs 207 to the lower end of the punch sleeve 164. The lower portion of the central passageway 206 has a height which is greater than the height of the punch 160. The diameters of the aperture 201 and the central passageway 206 at the free ends of the ribs 207 is slightly greater than the shaft 182 of the punch actuator 162, but is smaller than the diameter of the punch actuator 162 at the protrusions 199. The diameter of the central passageway 206 at the lower portion and is greater than the outer diameter of the punch 160. The outer diameter of the punch sleeve 164 is less than the bore 62 through the upper portion 50 of the lower frame 22 such that the punch sleeve 164 can move within the bore 62 during the punching process. The outer diameter of the punch sleeve 164 is greater than the bore 56 through the lower portion 46 of the lower frame 22 such that the punch sleeve 164 cannot move into the bore 56 during the punching process.

The spring 166 is a wave or coil spring having a central passageway 208 therethrough. The spring 166 is normally expanded.

To assemble the upper assembly 158, the shaft 182 of the punch actuator 162 is inserted into the central passageway 208 of the spring 166 until the end of the spring 166 abuts against the lower surface of the base wall 186. The shaft 162 is then inserted through the aperture 201 and into the central passageway 206 of the punch sleeve 164 until the upper end of the punch sleeve 164 abuts against the lower end of the spring 166. The protrusions 199 pass through the recesses 201*a*, 201*b* and are positioned within the elongated recesses 209 between adjacent ribs 207. Thereafter, the spring 166 is compressed between the punch sleeve 164 and the base wall 186 of the punch actuator 162 until the protrusions 199 clear the bottom ends of the ribs 206. The punch sleeve 164 and punch actuator 162 are rotated relative to each other until the protrusions 199 are no longer aligned with the recesses 201*a*, 201*b*. The spring 166 is thereafter allowed to return to its normal position. As a result, the protrusions 199 engage within new elongated recesses 209 between new adjacent ribs 207. Engagement of the protrusions 199 and the punch sleeve 164 prevent the punch sleeve 164 from rotating relative to the punch actuator 162 and spring 166, and also prevents the punch actuator 162 from disengaging from the punch sleeve 164 because the protrusions 199 will engage the top wall 203 at the maximum upward travel of the punch actuator 162 relative to the punch sleeve 164. As a result, no fasteners are required to connect the punch actuator 162, the spring 166, and the punch sleeve 164 together.

The punch 160 is connected to the shaft 182 by the fastener 168, such as a screw. Therefore, only a screw driver is needed to assemble the punch 160 with the punch actuator 162. The threaded shaft 210 of the fastener 168 is inserted into the recess of the punch 160 and passes through the aperture 176 in the base wall 174. The head 212 of the fastener 168 abuts against the lower surface of the base wall 174. The shaft 210 is then threaded into a threaded aperture in the lower end of the shaft 182, or the shaft 210 is used to form an aperture in the lower end of the shaft 182 during assembly, to complete the connection. The upper surface of the base wall 174 of the punch 160 abuts against the lower end of the ribs 207 within the punch sleeve 164. As shown in FIG. 14, when upper assembly 158 of the punching assembly 26 is not in contact with the lower assembly 152 (the lower assembly 152 is not shown in FIG. 14), then the spring 166 is fully expanded, and the punch 160 sits within the punch sleeve 164 engaging the lower end of the ribs 207 and such that the lower end of the punch sleeve 164 extends beyond the cutting/punching edge 180 of the punch 160. Because only a fastener 168, such as a screw, is needed to assemble the punch 160 with the punch actuator 162, the punch 160 can be easily assembled with or removed from the punch actuator 162 using only a screw driver. As a result, the punch 160 can be easily changed in the field without disassembling the stud punch tool 20.

The upper assembly 158 of the punching assembly 26 is connected to the upper handle 24 by inserting the body portion 94 at the gap 126 through the slot 202 until the horizontal sections 196, 200 of the L-shaped arms 188, 190 are above the forward lip 120. The forward lip 120 then slides within the passageway 204. The upper assembly 158 is moved along the forward lip 120 until it reaches the cam surface 122 on the upper handle 24. As a result, the cam surfaces 194, 197 engage the upper surface of the forward lip 120 and the cam surface 192 engages the lower surface of the forward lip 120.

To assemble the combined upper handle 24 and upper assembly 158 with the lower frame 22 and the lower assembly 152, the upper assembly 158 is passed through the bore 62 in the upper portion 50 until the aperture 116 in the upper handle 24 aligns with the apertures 68, 74 in the first and second ears 34, 36. The upper handle 24 is then pivotally attached to the first and second ears 34, 36 by a pin 214 which extends through the aperture 68 in the first ear 34, through the aperture 116 in the upper handle 24, and through the aperture 74 in the second ear 36. A nut 216 is threaded onto a threaded end of the pin 124 to secure the upper handle 24 onto the ears 34, 36.

An operation of the stud punch tool 20 will now be discussed. The user uses the stud punch tool 20 to punch a hole in a workpiece, for instance, a steel stud or a piece of sheet metal to allow the user to run PVC pipe therethrough. The stud may be U-shaped.

FIG. 1 shows the stud punch tool 20 in an intermediate position where the upper handle 24 is neither in a fully closed position or in a fully open position.

To move the stud punch tool 20 to the open position such that a workpiece can be inserted between the punch 160 and the die 154, the clip 98 is moved rearwardly on the rearward section 112 of the upper handle 24 until the upper wall 92 of the clip retainer 88 disengages from the lower passageway 150 in the clip 98. Thereafter, the rear end of the upper handle 24 is pulled upwardly away from to the lower frame 22 such that the upper handle 24 pivots around pin 214 relative to the lower frame 22. Upon this pivoting of the upper handle 24, the cam surface 122 on the upper handle 24 slides against the cam surfaces 195, 197 on the punch actuator 162 until the cam surface 122 on the upper handle 24 no longer engages the cam surfaces 195, 197, and instead, the front lip 118 engages the cam surfaces 195, 197. As a result, the upper assembly 158 moves upwardly away from the lower assembly 152 as the rear end of the upper handle 24 is moved away from the lower frame 22. The cam surfaces 195, 197 provide for the faster opening of the stud punch tool 20. The upper assembly 158 slides within the bore 62 of the upper portion 50 of the head portion 32, but the upper handle 24 cannot be pivoted so far that the upper assembly 158 disengages with the upper portion 50.

When in the open position, the upper assembly 158 is positioned as shown in FIG. 14. The spring 166 is fully expanded, such that the punch 160 sits within the punch sleeve 164.

To move the stud punch tool 20 to the closed position to punch the workpiece, the upper handle 24 is moved by pushing the rear end of the upper handle 24 toward the lower frame 22, such that the upper handle 24 pivots around pin 214 relative to the lower frame 22. Upon pivoting of the upper handle 24, the cam surface 122 on the upper handle 24 slides against the cam surface 192 on the punch actuator 162 until the cam surface 122 on the upper handle 24 no longer engages the cam surface 192 on the punch actuator 162, and instead, the forward section lip 120 engages the cam surface 192. As a result, the upper assembly 158 of the punching assembly 26 moves downwardly toward the die 154. The upper assembly 158 slides within the bore 62 of the upper portion 50 of the head portion 32. Upon continued downward movement, the punch sleeve 164 contacts the upper surface of the workpiece and the downward movement of the punch sleeve 164 is terminated. Upon further continued downward movement of the upper handle 24, the punch actuator 162 and punch 160 continue to move relative to the punch sleeve 164, and the spring 166 compresses between the base wall 186 and the upper end of the punch sleeve 164. Eventually, the cutting/punching edge 180 of the punch 160 comes into contact with the workpiece and the punch 160 punches through the workpiece with the assistance of the die 154 helping to shear the workpiece in conjunction with the punch 160. The material of the workpiece that is punched, which forms a slug, may be expelled through the lower end of the bore 56. If the slug does not disengage from the punch 160, the punch sleeve 164 is used to strip the slug from the punch 164 as described herein. The workpiece then has a hole punched therethrough such that the user can insert PVC pipe therein.

Figure 2:
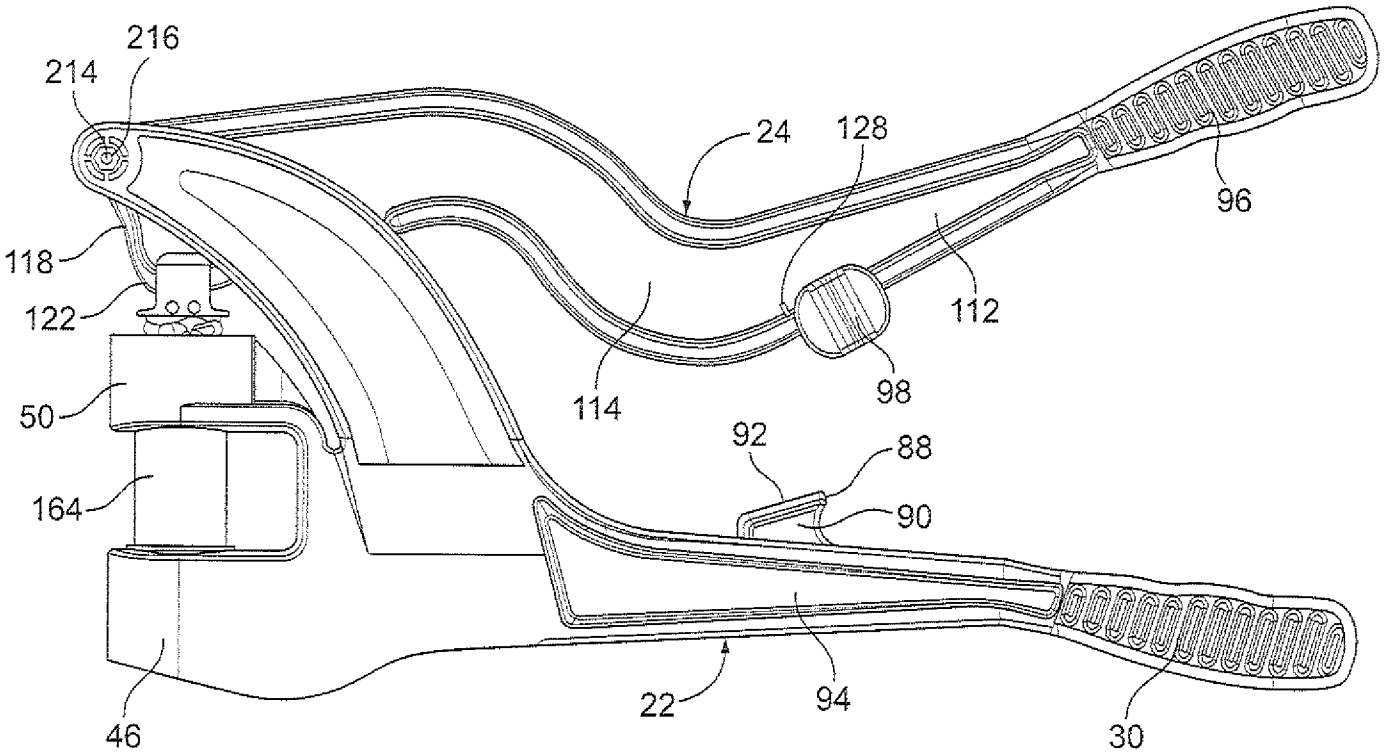
FIG. 2 is a side elevational view of the stud punch tool.
Figure 3:
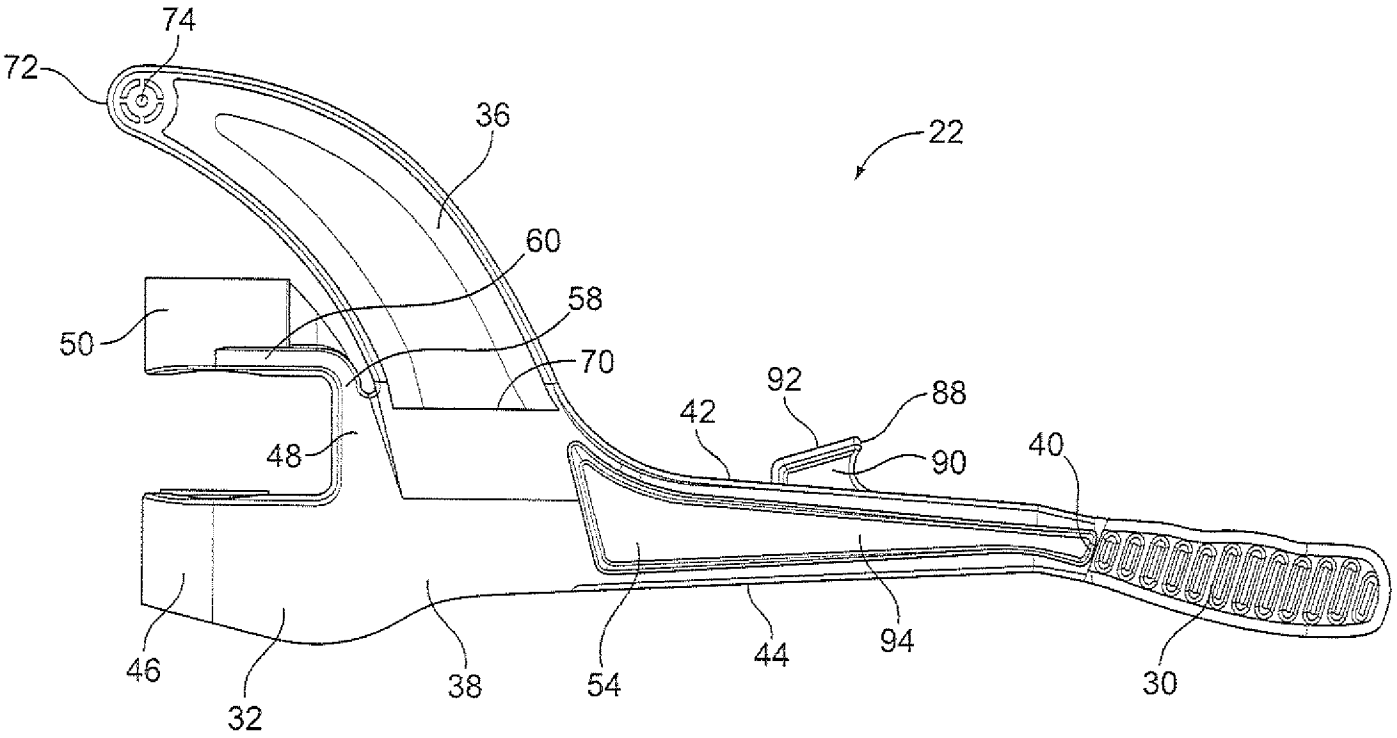
FIG. 3 is a side elevational view of a lower frame of the stud punch tool.

After the hole is punched in the workpiece, the upper handle 24 is then moved from its closed position shown in FIGS. 1 and 2 back to the open position as described above. Upon pulling the upper handle 24 away from the lower frame 22, the punch 160 and punch actuator 162 move upwardly until the upper end of the punch 160 engages the lower end of the ribs 207 of the punch sleeve 164. The punch sleeve 164 will maintain engagement with the workpiece until the force of the spring 166 is overcome when the punch 160 contacts the ribs 207 and the upper assembly 158 is continued to be moved upwardly. The engagement of the punch sleeve 164 with the workpiece keeps pressure on the workpiece (which may be a relatively thin sheet of material) during retraction of the punch 160 to ensure the uniformity the punched hole. During this movement, the lower end of the punch sleeve 164 moves past the lower end of the punch 160 as a result of the expansion of the spring 166, and the slug is stripped from the punch 160.

When not in use, the stud punch tool 20 is moved to the closed position (handle 24 and frame 22 close to each other) and the clip 98 is engaged with the clip retainer 88. When in this closed position, the lower surface of the curved middle section 114 of the upper handle 24 engages against the upper surface of the upper wall 92 of the clip retainer 88 and the stop 128 is forward of the clip retainer 88. The clip 98 is slid forwardly along the rearward section 112 of the upper handle 24 until the upper wall 92 of the clip retainer 88 engages within the lower passageway 150 in the clip 98. The lower wall 90 of the clip retainer 88 extends into the lower slot 144 of the clip 98.

The cam surfaces 122, 192, 195, 197 on the upper handle 24 and the punch actuator 162 provide a mechanical advantage and requires less punching force. The cam surfaces 122, 192, 195, 197 also eliminates the link provided by the stud punch tool disclosed in U.S. Pat. No. 6,647,630, therefore using fewer pieces, than that provided by the stud punch tool disclosed in U.S. Pat. No. 6,647,630.

Because of the structure of the stud punch tool 20, deflection of the head portion 32 is substantially eliminated, which could occur with the stud punch tool disclosed in U.S. Pat. No. 6,647,630. Since the connection of the upper handle 24 is not at the forward free end of the lower frame 22 as provided in the stud punch tool disclosed in U.S. Pat. No. 6,647,630, and, instead, the upper handle 24 is attached by the first and second ears 34, 36 to the midportion of the lower frame 22, the load placed on the lower frame 22 from the upper handle 24 is transferred along the first and second ears 34, 36 to the neutral plane 54 of the lower frame 22 at the rear of the lower frame 22 instead of at the front unsupported end. This provides several benefits including eliminating the need for the link disclosed in the stud punch tool disclosed in U.S. Pat. No. 6,647,630 (reducing part count by 30% versus the stud punch tool disclosed in U.S. Pat. No. 6,647,630, and reducing cost of manufacture over the stud punch tool disclosed in U.S. Pat. No. 6,647,630), and reducing the deflection of the head portion 32 which can lead to binding and wear on the stud punch tool 20. This also allows for use of more economical materials (for example, long glass composite material, glass filled nylon) and manufacturing processes (for example, injection molding) to make the stud punch tool 20. This will allow a significantly lighter weight stud punch tool 20 (40% reduction in weight over the stud punch tool disclosed in U.S. Pat. No. 6,647,630) which has lower modular of elasticity and which reduces fatigue for the user, making the user more productive, and which provide a lower cost to manufacture as a result of weight savings. Better lateral support for the upper handle 24 is also provided for in the upper handle 24 than that is provided by the stud punch tool disclosed in U.S. Pat. No. 6,647,630.

The punch sleeve 164 is formed of a molded plastic using self-lubricated acetyl resin. Prior art punch sleeves are formed of metal (machined out of steel). The use of molded plastic using self-lubricated acetyl resin in the present invention presents a significant cost savings over machined steel punch sleeves.

The spare die 154' and spare punch 160' have the same structure as the die 154 and punch 160 already described and therefore, the same reference numbers with a prime are used to denote like elements. It is to be understood that the spare die 154' and spare punch 160' may be of the same size (such that the same sized hole would be formed as the die 154 and punch 160), or may be of a difference size (such that a different sized hole would be formed as the die 154 and punch 160), or may have a different cutting/punching edge shape. The side wall 178' of the spare punch 160' is seated in the circular bore 172' in the die 154'. The combination die/punch 1547160' is then seated against the spare retaining frame 76 such that the base wall 174' of the punch 160' seats against the upper surface 42 of the body portion 94 and the flange 170' of the die 154' partially seats under the horizontal wall 86 of the spare retaining frame 76. The threaded shaft 210' of screw 168' is inserted into the recess of the die 154' and is passed through the aperture in the base wall 174' of the punch 80. The head 212' of the screw 168' abuts against the base wall 174'. The shaft 210' threads an aperture 78 in the body portion 92, or is threaded into a pre-threaded aperture 78, to retain the combination die/punch 154'/160' with the stud punch tool 20. The spare die 154' and punch 160' can be different than the one engaged with the punching assembly 26 to provide the user the ability to swap dies and punches so that different sized holes can be provided in the workpiece. Such removability and replaceability of the die and punch allows a user to use the stud punch tool 20 to punch a plurality of different sized holes and to replace a die and punch should they become worn.

The punch 160 can be easily changed by removing the screw 168 from the shaft 182 of the punch actuator 162 and the punch 160, and then attaching a new punch to the shaft 182 as discussed herein. The die 154 can be removed from the head portion 32 by engaging the flange 170 and pulling upwardly on the die 154 until the friction fit between the O-ring 156 the lower portion 46 is overcome. A new die, such as spare die 154', can then be inserted by pushing the new die into the lower portion 46.

While a preferred embodiment of the present invention is shown and described, it is envisioned that those skilled in the art may devise various modifications of the present invention without departing from the spirit and scope of the appended claims.

The invention claimed is:

1. A stud punch tool comprising:

a lower frame comprising a body portion having a front end and a rear end, a head portion having a front end and a rear end, said rear end of said head portion extending from said front end of said body portion, said head portion comprising an upper portion connected to a lower portion, said upper and lower portions being separated from each other by a space for receiving a workpiece to be punched therein, a handle portion extending from said rear end of said body portion and capable of being gripped by a user, a first ear having a fixed end and a free end, said fixed end extending from said body portion rearwardly of the head portion and forwardly of said handle portion, said first ear extending upwardly from said fixed end and toward said front end of said body portion and terminating in said free end positioned forwardly of said front end of said head portion such that a space is formed between said free end of said first ear and said head portion, a second ear having a fixed end and a free end, said fixed end of said second ear extending from said body portion rearwardly of the head portion and forwardly of said handle portion, said second ear extending upwardly from said fixed end and toward said front end of said body portion and terminating in said free end of said second ear positioned forwardly of said front end of said head portion such that a space is formed between said free end of said second ear and said head portion, said first and second ears being spaced apart from each other;

an upper handle attached to said free ends of said first and second ears at an attachment, said upper handle being moveable relative to said lower frame upon movement by a user; and a punching assembly connected to said head portion of said lower frame and connected to said upper handle, said attachment of said upper handle to said first and second ears being positioned forwardly of said punching assembly.

2. The stud punch tool as defined in claim 1, wherein said upper handle is attached to said first and second ears by a pin around which the upper handle is capable of pivoting relative to said lower frame.

3. The stud punch tool as defined in claim 1, wherein said upper handle includes a cam surface, and said punching assembly including a shaft having a cam engagement on an upper end thereof and a punch having a punching edge on a lower end thereof, said cam engagement forming at least one cam surface, said cam surface of said upper handle engaging with said at least one cam surface of said cam engagement, said upper handle and said shaft being moveable relative to each other.

4. The stud punch tool as defined in claim 3, wherein said upper handle is pivotally attached to said first and second ears.

5. The stud punch tool as defined in claim 3, wherein said shaft extends through said upper portion; and said punching assembly includes a die mounted in said lower portion.

6. The stud punch tool as defined in claim 5, wherein said die is removable from said lower portion.

7. The stud punch tool as defined in claim 5, wherein said punch is removable from said shaft.

8. The stud punch tool as defined in claim 7, wherein said punch is attached to said shaft by a single fastener.

9. The stud punch tool as defined in claim 7, wherein said die is removable from said lower portion.

10. A stud punch tool comprising:

a lower frame comprising a body portion having a front end and a rear end, a head portion having a front end and a rear end, said rear end of said head portion extending from said front end of said body portion, said head portion comprising an upper portion connected to a lower portion, said upper and lower portions being separated from each other by a space for receiving a workpiece to be punched therein, a handle portion extending from said rear end of said body portion and capable of being gripped by a user, a first ear having a fixed end and a free end, said fixed end extending from said body portion rearwardly of the head portion and forwardly of said handle portion, said first ear extending upwardly from said fixed end and toward said front end of said body portion and terminating in said free end, a second ear having a fixed end and a free end, said fixed end of said second ear extending from said body portion rearwardly of the head portion and forwardly of said handle portion, said second ear extending upwardly from said fixed end and toward said front end of said body portion and terminating in said free end of said second ear, said first and second ears being spaced apart from each other;

an upper handle attached to said free ends of said first and second ears, said upper handle including a cam surface, said upper handle being moveable relative to said lower frame upon movement by a user; and a punching assembly connected to said head portion of said lower frame and connected to said upper handle, said punching assembly including a shaft extending through said upper portion of said head portion and having a cam engagement on an upper end thereof, a punch having a punching edge on a lower end thereof and a die mounted in said lower portion, said cam engagement forming at least one cam surface, said cam surface of said upper handle engaging with said at least one cam surface of said cam engagement, said upper handle and said shaft being moveable relative to each other;

wherein an outer surface of said cam engagement extends beyond an outer surface of said shaft; and further including a sleeve having a passageway therethrough, said shaft being mounted within said passageway, and a spring mounted between an upper end of said sleeve and said cam engagement.

11. The stud punch tool as defined in claim 10, wherein said shaft includes a protrusion extending outwardly therefrom, said passageway of said sleeve includes at least two recesses therein, said protrusion is first positioned within one of said recesses and then positioned within the other of said recesses during assembly of said shaft with said sleeve.

12. The stud punch tool as defined in claim 10, wherein said sleeve is formed of acetyl resin and said lower frame and said upper handle are formed of one of long glass composite and nylon.

13. A stud punch tool comprising:

a lower frame comprising a body portion having a front end and a rear end, a head portion having a front end and a rear end, said rear end of said head portion extending from said front end of said body portion, a handle portion extending from said rear end of said body portion and capable of being gripped by a user, a first ear having a fixed end and a free end, said fixed end extending from said body portion rearwardly of the head portion and forwardly of said handle portion, said first ear extending upwardly from said fixed end and toward said front end of said body portion and terminating in said free end, a second ear having a fixed end and a free end, said fixed end of said second ear extending from said body portion rearwardly of the head portion and forwardly of said handle portion, said second ear extending upwardly from said fixed end and toward said front end of said body portion and terminating in said free end of said second ear, said first and second ears being spaced apart from each other;

an upper handle attached to said free ends of said first and second ears, said upper handle includes a lip which extends outwardly from said body portion, said lip forming a cam surface of said upper handle, said upper handle being moveable relative to said lower frame upon movement by a user; and a punching assembly connected to said head portion of said lower frame and connected to said upper handle, said punching assembly including a shaft, a cam engagement on an upper end of said shaft, and a punch having a punching edge on a lower end of said shaft, said cam engagement comprising a first cam surface at an upper end of said shaft, a pair of arms extending from opposite sides of said first cam surface, each said arm having a vertical section and a horizontal section, said horizontal section being spaced from said first cam surface, a cam surface formed on a lower end of said horizontal section thereby defining second and third cam surfaces, a passageway formed between said first cam surface and said second and third cam surfaces, said first, second and third cam surfaces engaging with said lip on said upper handle such that said lip is positioned within said passageway.

14. The stud punch tool as defined in claim 1, further including a clip provided on said upper handle and a clip retainer provided on said lower frame, said clip being engageable with said clip retainer.

15. The stud punch tool as defined in claim 14, wherein said clip is slidable on said upper handle, and said upper handle includes a stop provided thereon for preventing movement of said clip in a forward direction.

16. The stud punch tool as defined in claim 14, wherein said upper handle further includes a lip which extends outwardly from said body portion, said clip having a passageway therein in which the lip is positioned.

17. The stud punch tool as defined in claim 16, wherein said clip includes a second passageway, said clip retainer being positioned within said second passageway when said clip is engaged with said clip retainer.

18. The stud punch tool as defined in claim 1, wherein said head portion is C-shaped.

19. The stud punch tool as defined in claim 18, wherein said head portion comprises an upper horizontal portion connected to a lower horizontal portion by a middle vertical portion, said upper and lower portions being separated from each other by a space for receiving a workpiece to be punched therein, said upper portion having a bore therethrough;

said punch assembly including a shaft extending through said bore of said upper portion, and a punch having a punching edge provided at a lower end of said shaft.

20. A stud punch tool comprising:

a lower frame;

an upper handle including a cam surface, said upper surface attached to said lower frame, said upper handle being moveable relative to said lower frame upon movement by a user; and a punching assembly attached to said lower frame and to said upper handle, said punching assembly including a shaft, a cam engagement on an upper end of said shaft, and a punch having a punching edge on a lower end of said shaft for engagement with a workpiece, said cam engagement comprising a first cam surface at an upper end of said shaft, a pair of arms extending from opposite sides of said first cam surface, each said arm having a vertical section and a horizontal section, said horizontal section being spaced from said first cam surface, a cam surface formed on a lower end of said horizontal section thereby defining second and third cam surfaces, a passageway formed between said first cam surface and said second and third cam surfaces, said first, second and third cam surfaces engaging with said cam surface of said upper handle such that said cam surface of upper handle is positioned within said passageway, said upper handle and said punching assembly being moveable relative to each other.

21. The stud punch tool as defined in claim 20, wherein said upper handle has a body portion and said cam surface on said upper handle is formed from a lip which extends outwardly from said body portion.

22. The stud punch tool as defined in claim 20, wherein said lower frame includes a head portion comprising an upper portion connected to a lower portion, said upper and lower portions being separated from each other by a space for receiving a workpiece to be punched therein;

said shaft extending through said upper portion of said head portion and being moveable relative to said upper portion of said head portion.

23. The stud punch tool as defined in claim 22, wherein said lower portion of said head portion includes a die which is removable from said lower portion.

24. The stud punch tool as defined in claim 20, wherein said punch is removable from said punch shaft.

25. The stud punch tool as defined in claim 20, wherein said lower frame comprises a body portion having a front end and a rear end, a head portion having a front end and a rear end, said punching assembly being received in said head portion, said rear end of said head portion extending from said front end of said body portion, a handle portion extending from said rear end of said body portion and capable of being gripped by a user, a first ear having a fixed end and a free end, said fixed end extending from said body portion rearwardly of the head portion and forwardly of said handle portion, said first ear extending upwardly from said fixed end and toward said front end and terminating in said free end, a second ear having a fixed end and a free end, said fixed end of said second ear extending from said body portion rearwardly of the head portion and forwardly of said handle portion, said second ear extending upwardly from said fixed end and toward said front end and terminating in said free end of said second ear, said first and second ears being spaced apart from each other, said upper handle being attached to said free ends of said first and second ears.

26. A stud punch tool comprising:

a lower frame comprising a body portion having a front end and a rear end, a head portion having a front end and a rear end, said rear end of said head portion extending from said front end of said body portion, a handle portion extending from said rear end of said body portion and capable of being gripped by a user;

an upper handle attached to said lower frame and being moveable relative to said lower frame upon movement by a user; and a punching assembly connected to said head portion of said lower frame and connected to said upper handle, said punching assembly including a shaft having a cam engagement on an upper end thereof and a punch having a punching edge on a lower end thereof, a sleeve having a passageway therethrough, said passageway including at least two recesses therein, said shaft including a protrusion extending outwardly therefrom, said protrusion being first positioned within one of said recesses and then positioned within the other of said recesses during assembly of said shaft with said sleeve, and a spring mounted between an upper end of said sleeve and said cam engagement.

27. The stud punch tool as defined in claim 26, wherein said upper handle includes a cam surface, said cam surface of said upper handle engaging with said cam engagement, said upper handle and said shaft being moveable relative to each other.

28. The stud punch tool as defined in claim 26, wherein said head portion comprising an upper portion connected to a lower portion, said upper and lower portions being separated from each other by a space for receiving a workpiece to be punched therein;

said shaft extending through said upper portion; and said punching assembly includes a die mounted in said lower portion.

29. The stud punch tool as defined in claim 28, wherein said die is removable from said lower portion.

30. The stud punch tool as defined in claim 29, wherein said punch is removable from said shaft.

31. The stud punch tool as defined in claim 26, wherein said shaft sleeve is formed of acetyl resin and said lower frame and said upper handle are formed of one of long glass composite and nylon.

32. The stud punch tool as defined in claim 20, wherein said lower frame and said upper handle are formed of one of long glass composite and nylon.

33. A stud punch tool comprising:

a lower frame comprising a body portion having a front end and a rear end, a head portion having a front end and a rear end, said rear end of said head portion extending from said front end of said body portion, said head portion comprising an upper portion connected to a lower portion, said upper and lower portions being separated from each other by a space for receiving a workpiece to be punched therein, a handle portion extending from said rear end of said body portion and capable of being gripped by a user, a first ear having a fixed end and a free end, said fixed end extending from said body portion rearwardly of the head portion and forwardly of said handle portion, said first ear extending upwardly from said fixed end and toward said front end of said body portion and terminating in said free end such that a space is formed between said free end of said first ear and said head portion, a second ear having a fixed end and a free end, said fixed end of said second ear extending from said body portion rearwardly of the head portion and forwardly of said handle portion, said second ear extending upwardly from said fixed end and toward said front end of said body portion and terminating in said free end of said second ear such that a space is formed between said free end of said second ear and said head portion, said first and second ears being spaced apart from each other;

an upper handle attached to said free ends of said first and second ears, said upper handle being moveable relative to said lower frame upon movement by a user, said upper handle includes a cam surface; and a punching assembly connected to said head portion of said lower frame and connected to said upper handle, said punching assembly including a shaft having a cam engagement on an upper end thereof and a punch having a punching edge on a lower end thereof, said cam engagement forming at least one cam surface, said cam surface of said upper handle engaging with said at least one cam surface of said cam engagement, said upper handle and said shaft being moveable relative to each other.

34. The stud punch tool as defined in claim 33, wherein said upper handle is pivotally attached to said first and second ears.

35. The stud punch tool as defined in claim 33, wherein said shaft extends through said upper portion; and said punching assembly includes a die mounted in said lower portion.

* * * * *

UNITED STATES PATENT AND TRADEMARK OFFICE

CERTIFICATE OF CORRECTION

PATENT NO. : 8,782,908 B2
APPLICATION NO. : 12/643461
DATED : July 22, 2014
INVENTOR(S) : Moffatt et al.

It is certified that error appears in the above-identified patent and that said Letters Patent is hereby corrected as shown below:

On the Title Page, Item [56], in Column 2, Line 1, delete "0/1905" and insert -- 05/1905 --, therefor.

In the Specification

Column 1, Line 33, delete "Morever," and insert -- Moreover, --, therefor.

Column 2, Line 51, delete "end 38" and insert -- end 40 --, therefor.

Column 3, Line 24, delete "section 58." and insert -- section 40. --, therefor.

Column 3, Line 45, delete "second first ear" and insert -- second ear --, therefor.

Column 3, Line 49, delete "apertures 68, 72" and insert -- apertures 68, 74 --, therefor.

Column 3, Line 51, delete "portions 44, 46" and insert -- portions 46, 44 --, therefor.

Column 3, Line 66, delete "surface 46" and insert -- surface 42 --, therefor.

Column 4, Lines 25-26, delete "A aperture" and insert -- An aperture --, therefor.

Column 6, Line 13, delete "wall 176." and insert -- wall 174. --, therefor.

Column 6, Line 18, delete "a can" and insert -- a cam --, therefor.

Column 6, Line 26, delete "arm 184" and insert -- arm 188 --, therefor.

Column 6, Line 47, delete "the earn" and insert -- the cam --, therefor.

Column 7, Line 28, delete "shaft 162" and insert -- shaft 182 --, therefor.

Signed and Sealed this
Seventh Day of October, 2014

Michelle K. Lee

Michelle K. Lee
*Deputy Director of the United States Patent and Trademark Office*

Column 7, Line 37, delete “ribs 206.” and insert -- ribs 207. --, therefor.

Column 10, Line 47, delete “1547160'” and insert -- 154'/160' --, therefor.

Column 10, Line 56, delete “portion 92,” and insert -- portion 94, --, therefor.

Column 10, Line 67, delete “screw 168” and insert -- screw 168' --, therefor.